United States Patent [19]

Reeberg

[11] 4,339,837

[45] Jul. 20, 1982

[54] PAINT BRUSH ACCESSORY

[76] Inventor: Christiaan Reeberg, 111-67 145th St., Jamaico, N.Y. 11435

[21] Appl. No.: 200,963

[22] Filed: Oct. 27, 1980

[51] Int. Cl.[3] ..... A46B 9/10; A46B 17/04

[52] U.S. Cl. ..... 15/169; 15/246; 15/257 R; 206/361

[58] Field of Search ..... 15/166, 168, 169, 170, 15/246, 248 R, 257 R; 206/361; 248/110, 111, 113

[56] References Cited

U.S. PATENT DOCUMENTS 2,956,676 10/1960 Dgetluck ..... 206/361
3,148,767 9/1964 Dgetluck ..... 206/361
4,129,918 12/1978 Lee ..... 15/169
4,237,579 12/1980 Salmon ..... 15/169

FOREIGN PATENT DOCUMENTS 811394 4/1959 United Kingdom ..... 15/169

*Primary Examiner*—Peter Feldman

[57] ABSTRACT

The bristles of a paint brush are confined by a sliding box-like girdle of a one-piece accessory the back of which is part of a plate-like shield having a short edger portion extending below the girdle with the main portion extending parallel to and alongside of the brush, ending in an arched flange and containing a hole which serve as a finger-piece and auxiliary hanger, respectively, for the accessory, as well as for the brush when combined with the brush as a kit.

2 Claims, 3 Drawing Figures

PAINT BRUSH ACCESSORY

BACKGROUND OF THE INVENTION

This invention relates to paint brush attachments such as girdles, sleeves, guards, edge controls, guides for the bristles in painting window frames and the like.

Prior art patents of interest include:

| Number | Patentee | Date |
|---|---|---|
| 2,345,991 | Rishel | April 4, 1944 |
| 2,821,734 | Carrabine | Feb. 4, 1958 |
| 3,197,795 | Forte | Aug. 3, 1965 |
| 3,210,791 | Rogholt | Oct. 12, 1965 |
| 3,049,741 | Bessette | Aug. 21, 1962 |
| 3,341,879 | Kumpman | Sept. 19, 1967 |

Rishel proposes a sliding bristle girdle to catch backward paint drainage.

Carrabine uses a pivoted side guard to back the edge of the bristles.

Forte discloses a bristle guard that is open on one side.

Rogholt has a blade edger that is pivoted adjacent the ferrule.

Bessette is concerned with a paint brush guide made of two parts, one of which partially embraces the bristles adjacent the ferrule, and the other is a flat tongue that can slide between the first part and the bristles.

Kumpman provides an edger that is pivoted to a girdle that is fixed to the brush ferrule.

Such proposals are more or less complicate and relatively expensive.

The main object of this invention is to provide a one-piece paint brush accessory that is simple in construction, easy to make and use, and possesses the following features:

1. Forms with the brush, a sales kit for displaying both the brush and the accessory.
2. Confines and protects the brush bristles while on display as well as when drying and/or during storage.
3. Adjusts longitudinally of the bristles to control the effective length of the bristle ends in painting.
4. Serves to squeeze excess paint from the bristles after each dip.
5. Provides an auxiliary hanger for the brush.
6. Adds very little to the cost, size, and/or weight of the brush.

BRIEF DESCRIPTION OF THE INVENTION

The bristles of a brush are confined for a portion of their length by a rectangular, box-like girdle having an integral, plate-like shield that extends upwardly parallel to the brush which ends in an arched lateral flange that also provides a finger piece for adjusting the box longitudinally with respect to the brush. The girdle, shield and finger-piece are made preferably of a single piece of thin but rigid plastic, which before sale, serves as a protective package for the bristles, as well as an auxiliary hanger for the brush.

To paint near an edge, such as a window frame, the girdle is adjusted to confine the bristles near the end of the brush, to prevent the ends of the bristles from spreading to the glass adjacent the frame. After painting with the brush, the box provides a bristle confiner, which keeps them from flaring upon drying, and also provides a convenient auxiliary hanger for the brush for display and/or storage. The accessory also provides means for stripping excess paint from the bristles after each dip.

BRIEF DESCRIPTION OF THE DISCLOSURE

The bristles of a paint brush are confined by a girdle for a portion of their length. Such girdle is part of a one-piece accessory that includes an integral plate-like shield that extends from the edge of the girdle parallel alongside of the brush ferrule and handle. The shield ends in a lateral arcuate flange which also serves as a finger-piece with which the girdle can be adjusted longitudinally of the bristle ends. Thus, for painting window frames, this effective length of the bristles can be controlled to prevent flaring adjacent the frame, onto the glass.

The accessory and brush are packaged for sale as a kit; in which case the girdle holds the bristles together. Also, after cleaning the brush the girdle keeps the bristles from undesirably flaring as they dry, while the brush is hung by means of a hole in the accessory on a hook. In painting, the girdle can be used to strip and/or squeeze excess paint from the bristles by sliding the girdle toward the ends thereof, then retracting the girdle to a desired edging position for painting frames.

The accessory is made preferably of thin but stiff plastic, so that it is light in weight, and inexpensive to make, for sale with the brush as a kit.

DETAILED DESCRIPTION OF THE INVENTION

Figure 1:
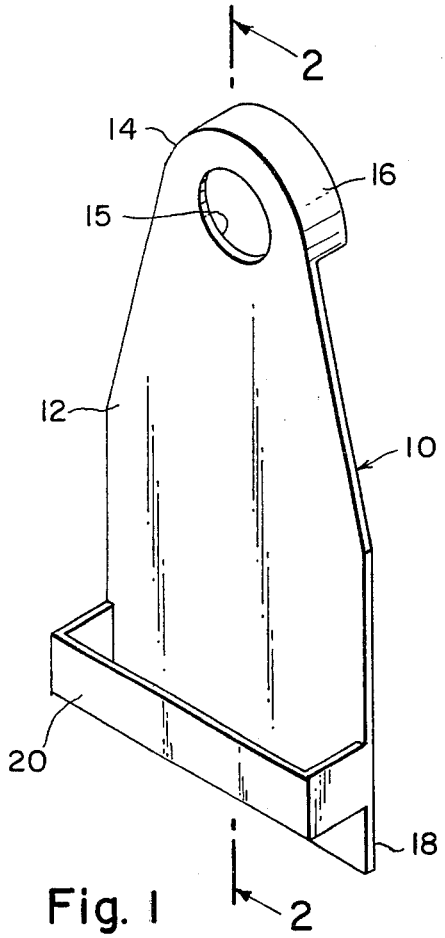
FIG. 1 is a perspective view of a paint brush accessory illustrative of the invention.
Figure 2:
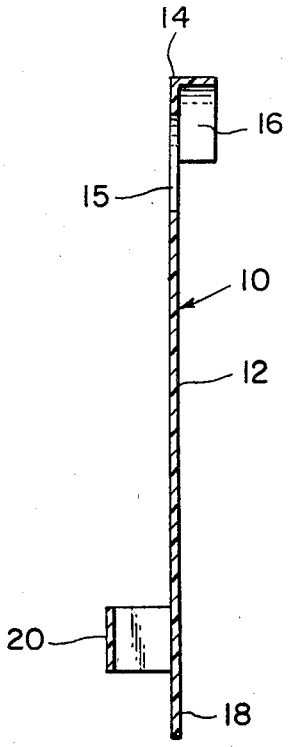
FIG. 2 is a vertical cross section taken on line 2—2 of FIG. 1.
Figure 3:
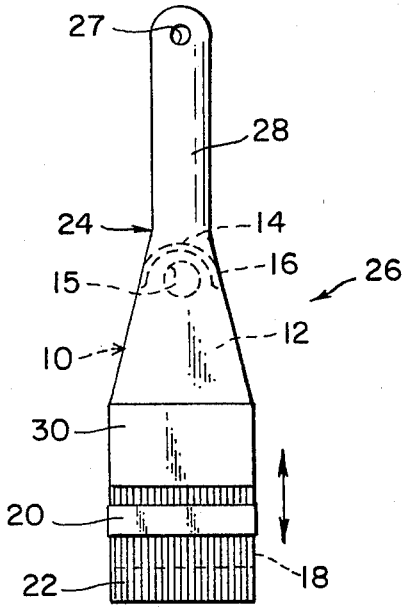
FIG. 3 is a view in front elevation of the accessory-brush assembly or kit.

The illustrated paint brush accessory 10 consists of a plate-like shield 12 having an arched top 14 containing a hole 15 above which is an arcuate lip or flange 16. The hole 15 and flange 16 serve as a hanger and fingertip, respectfully. A short distance above the lower edge 18 of the shield 12 is connected an integral rectangular member 20 forming with the shield 12 a girdle for the bristles 22 of a paint brush 24. The lower edge 18 of the shield extends downwardly below said girdle 20 to a length such that the girdle can encompass the bristles 22 while said lower edge is in cooperative engatement with the free ends of said bristles. The accessory is made in one piece preferably of relatively thin but stiff plastic.

When assembled with the brush 24, the accessory 10 forms therewith a convenient kit 26 for merchandizing and display purposes. In such case the girdle 20 contains the bristles 22, holding them in place, while the hole 15 and flange 16 also provide a hanger in case the hole 27 near the top of the brush handle 28 is not suitable. The shield 12 is shaped like the brush ferrule 30 which connects the handle 28 and bristles 22.

By means of the finger-piece 16 the accessory 10 can be adjusted longitudinally of the brush 24 for the purpose of either squeezing excess paint from the bristles 22 with the girdle 20, or controlling the exposed length of the ends of the bristles for edge painting window frames, for example, by keeping the bristle ends from flaring during the painting. After cleaning the brush 24 the girdle 20, also serves to keep the bristles 22 straight during drainage and drying.

What is claimed is:

1. A one piece accessory for paint brushes having bristles connected by a single ferrule to a handle in line therewith; comprising (a) a single integral rectangular box-like girdle connecting said accessory to said paint brush, said girdle slidingly embracing said bristles;

an integral flat plate-like straight edger shield extending upwardly and downwardly from one sidewall of said girdle, alongside of and parallel to the brush ferrule and handle above the girdle, as well as to the bristles below; and (A) a lateral integral arcuate flange extending at right angles to the upper end of said shield, which flange serves as a finger piece for reinforcing and for manually adjusting said girdle alongside of and longitudinally with respect to the free end of said bristles to confine and control the bristles before as well as during painting; the lower edge of said flat plate-like shield which extends below said girdle being straight and extending downwardly below said girdle to a length such that said girdle encompasses a portion of the length of said bristles when said lower edge of said shield is in cooperative engagement with the free ends of said bristles during painting, said girdle serving to control the effective length of said bristles as well as to strip or squeeze excess paint therefrom, and provides a sales display kit in which the brush bristles are protected and held in place by the girdle.

2. A one piece accessory for paint brushes, as defined by claim 1, in which said girdle and shield are made of thin but stiff plastic.

* * * * *